US007311619B1

(12) United States Patent
Leftwich

(10) Patent No.: US 7,311,619 B1
(45) Date of Patent: Dec. 25, 2007

(54) RACQUET AND BALL SPORT COURT AND TARGET SYSTEM

(75) Inventor: Don "Kip" Leftwich, Metairie, LA (US)

(73) Assignee: Accutennis, LLC, Metairie, LA (US)

( * ) Notice: Subject to any disclaimer, the term of this patent is extended or adjusted under 35 U.S.C. 154(b) by 236 days.

(21) Appl. No.: 11/204,299

(22) Filed: Aug. 15, 2005

Related U.S. Application Data

(60) Provisional application No. 60/611,206, filed on Sep. 17, 2004, provisional application No. 60/601,554, filed on Aug. 13, 2004.

(51) Int. Cl.
*A63B 67/00* (2006.01)

(52) U.S. Cl. ..... 473/474

(58) Field of Classification Search ..... 473/459, 473/465, 473, 474, 415, 422, 490
See application file for complete search history.

(56) References Cited

U.S. PATENT DOCUMENTS

| | | | | |
|---|---|---|---|---|
| 3,504,912 A | | 4/1970 | Jenney | |
| 4,045,022 A | | 8/1977 | Grant et al. | |
| 4,592,547 A | | 6/1986 | Thaxton | |
| 4,948,372 A | | 8/1990 | Stotland | |
| 5,709,620 A | | 1/1998 | Reinprecht | |
| 5,800,297 A | * | 9/1998 | Aldstadt | 434/247 |
| 5,816,953 A | | 10/1998 | Cleveland | |
| 5,928,095 A | * | 7/1999 | Aldstadt | 473/459 |
| 5,935,025 A | * | 8/1999 | Aldstadt | 473/490 |
| 5,976,039 A | * | 11/1999 | Epel | 473/490 |
| 6,077,176 A | * | 6/2000 | Poshaldo, Jr. | 473/490 |
| 6,135,456 A | | 10/2000 | Cooper | |
| 6,648,780 B1 | | 11/2003 | Boldin | |
| 2004/0157686 A1 | | 8/2004 | Sauer | |

* cited by examiner

*Primary Examiner*—Raleigh W. Chiu
(74) *Attorney, Agent, or Firm*—Garvey, Smith, Nehrbass & North, L.L.C.; Seth M. Nehrbass; Charles C. Garvey, Jr.

(57) ABSTRACT

A system for training to play better at tennis includes indicia for indicating desired target areas of a tennis court and rules for determining points to be given for striking a desired target area. Preferably, points are given only on the last shot of a play.

27 Claims, 16 Drawing Sheets

*Patent pending. AccuTennis is a trademark of tennis professional Kip Leftwich USPTA.

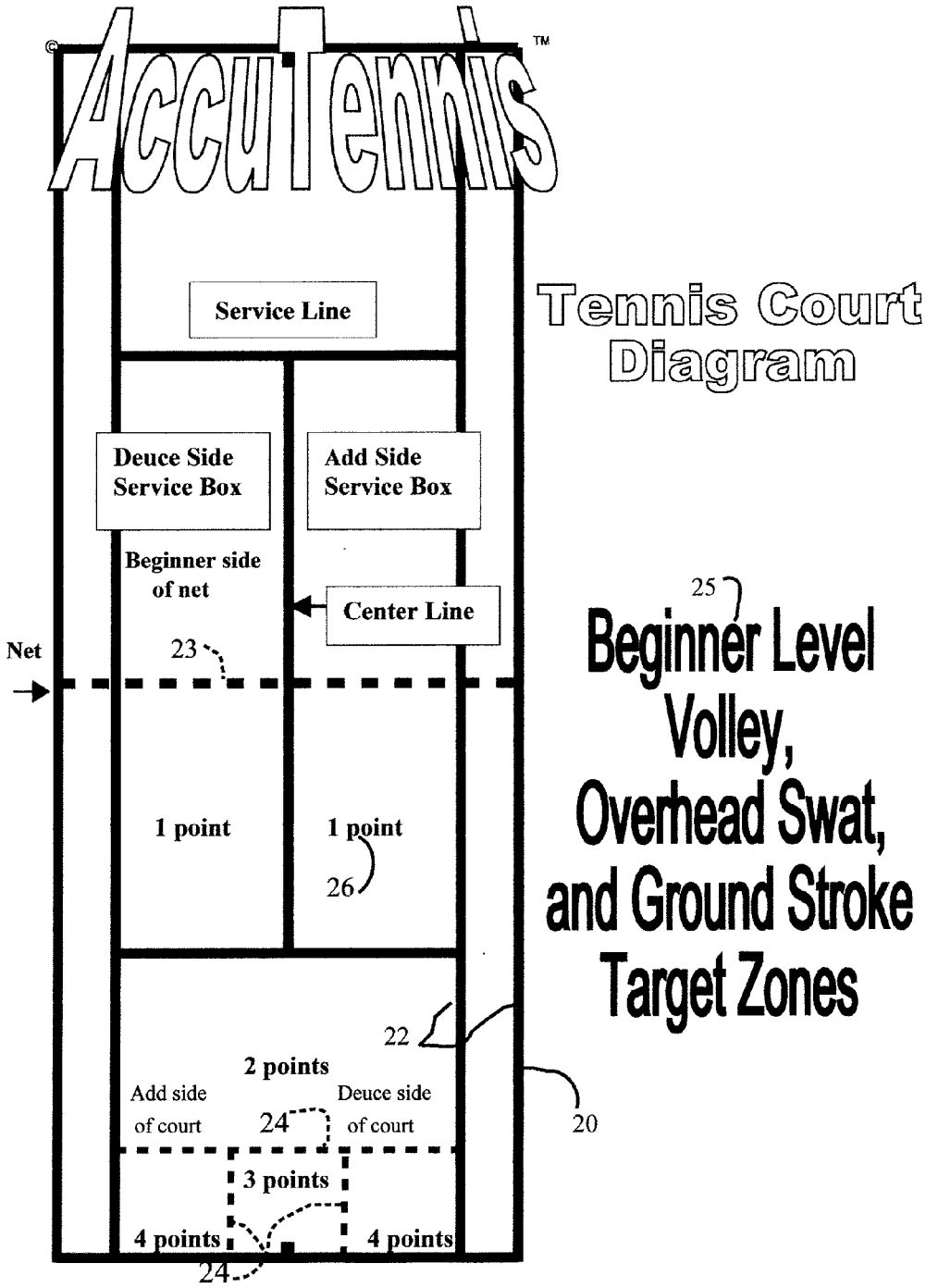
*Patent pending. AccuTennis® is a trademark of tennis professional Kip Leftwich, USPTA.
Figure 5.1

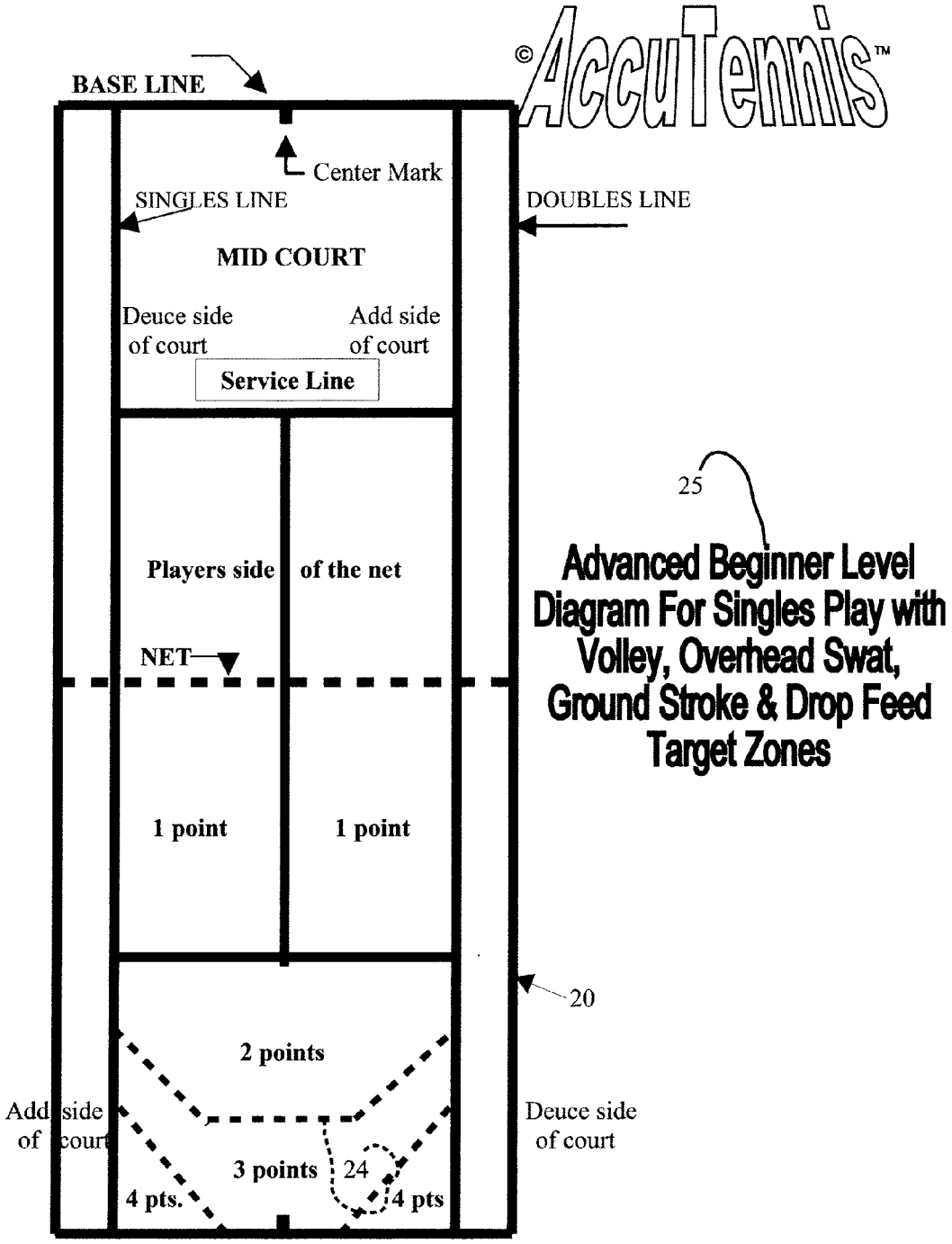
*Patent pending. AccuTennis™ is a trademark of tennis professional Kip Leftwich, USPTA.
Figure 5.2

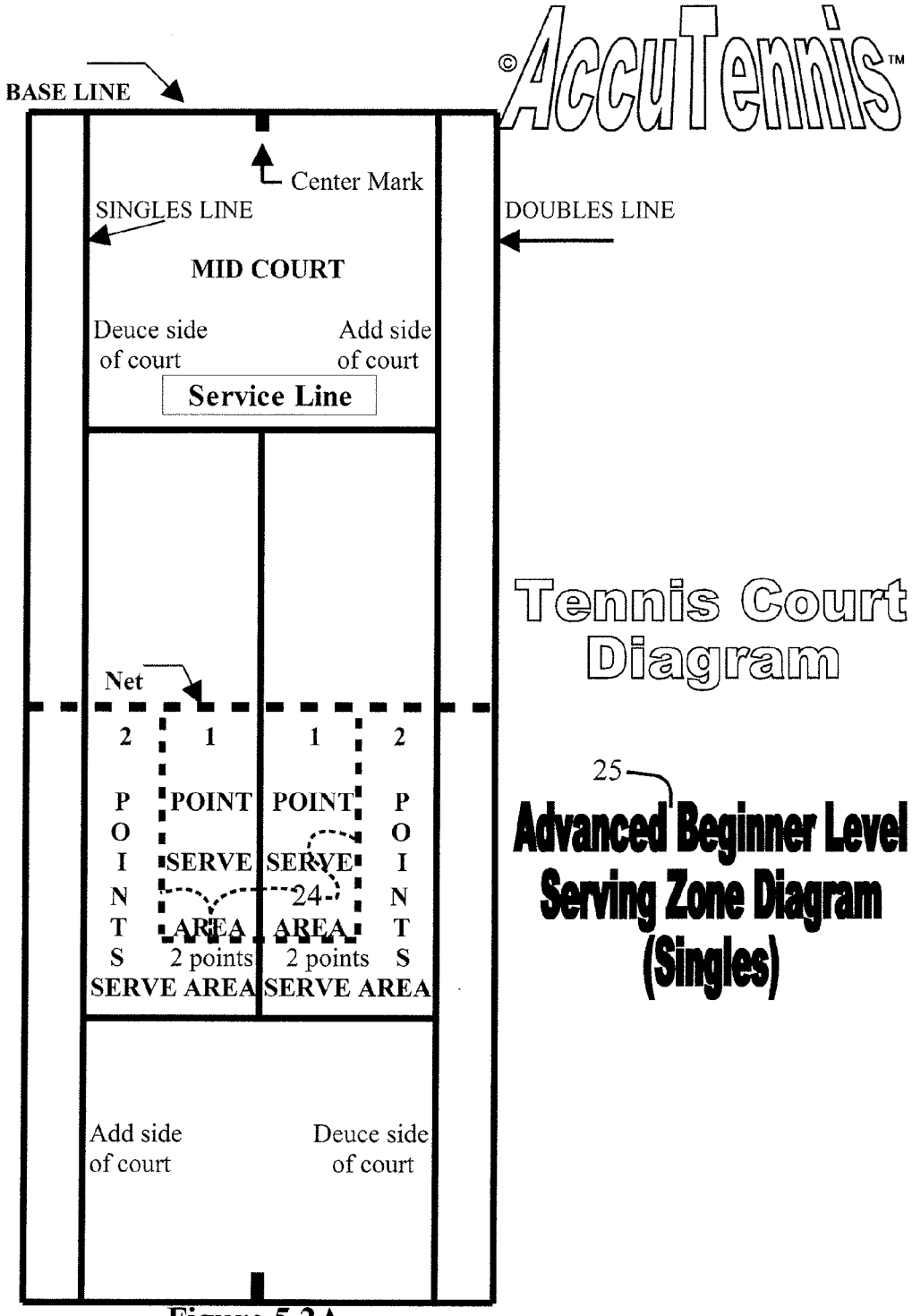
Figure 5.2A
*Patent pending. AccuTennis™ is a trademark of tennis professional Kip Leftwich, USPTA.

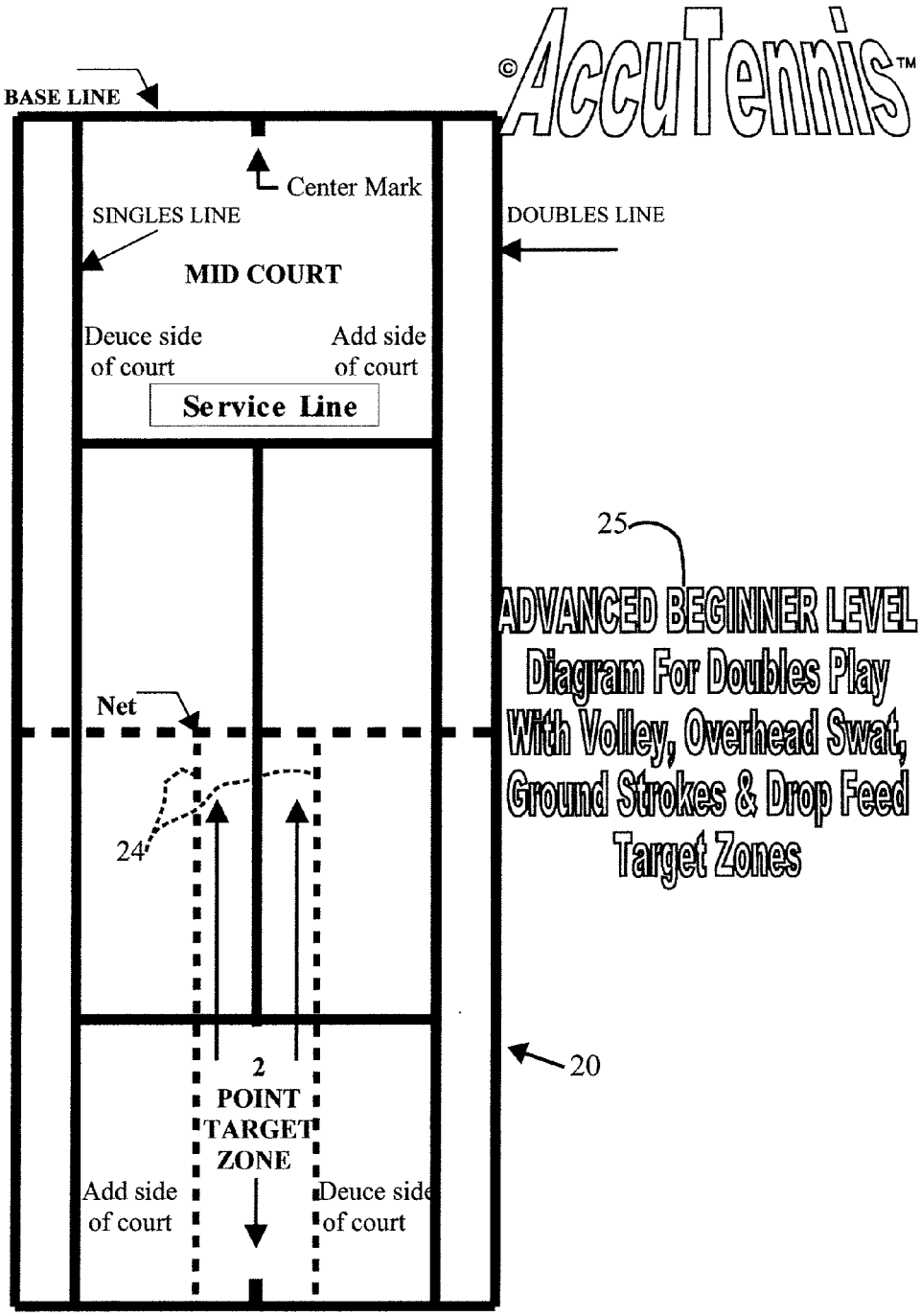
Note: Tennis balls that land outside the 2-Point Target Zone count for 1-Point.
*Patent pending. AccuTennis™ is a trademark of tennis professional Kip Leftwich, USPTA.
Figure 5.3

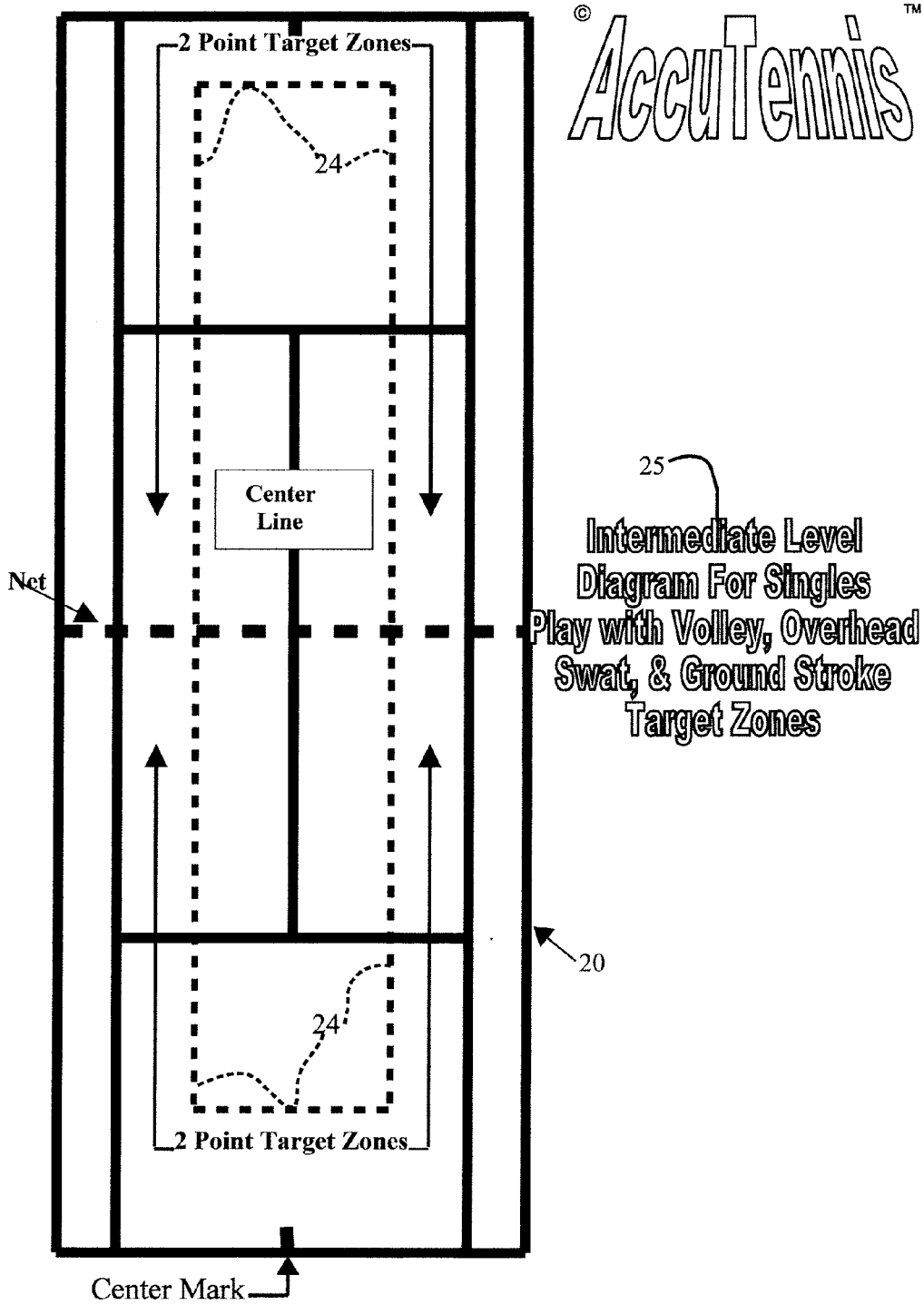
Figure 5.4
*Patent pending. AccuTennis™ is a trademark of tennis professional Kip Leftwich, USPTA.

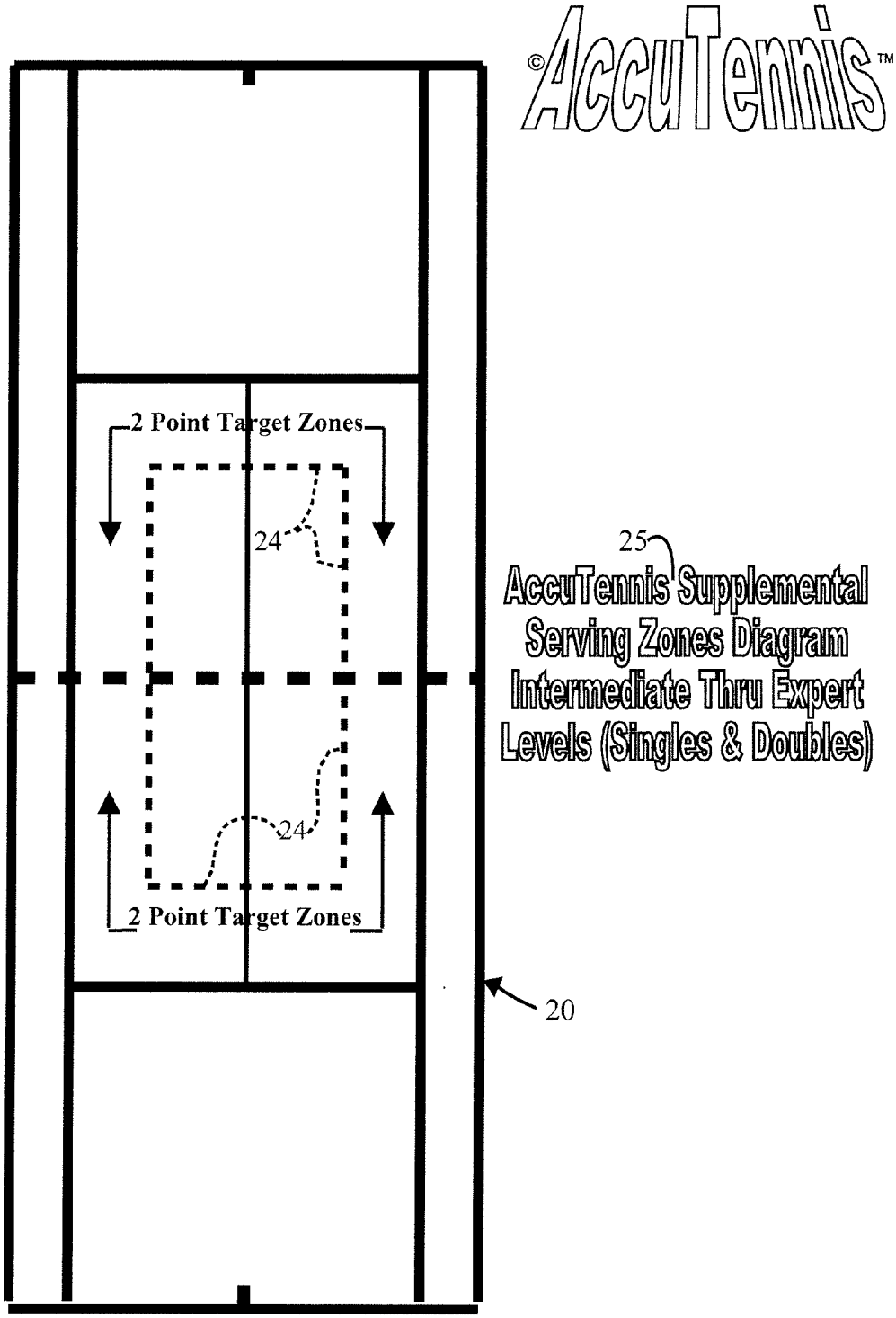
Figure 5.4A
*Patent pending. AccuTennis™ is a trademark of tennis professional Kip Leftwich, USPTA.

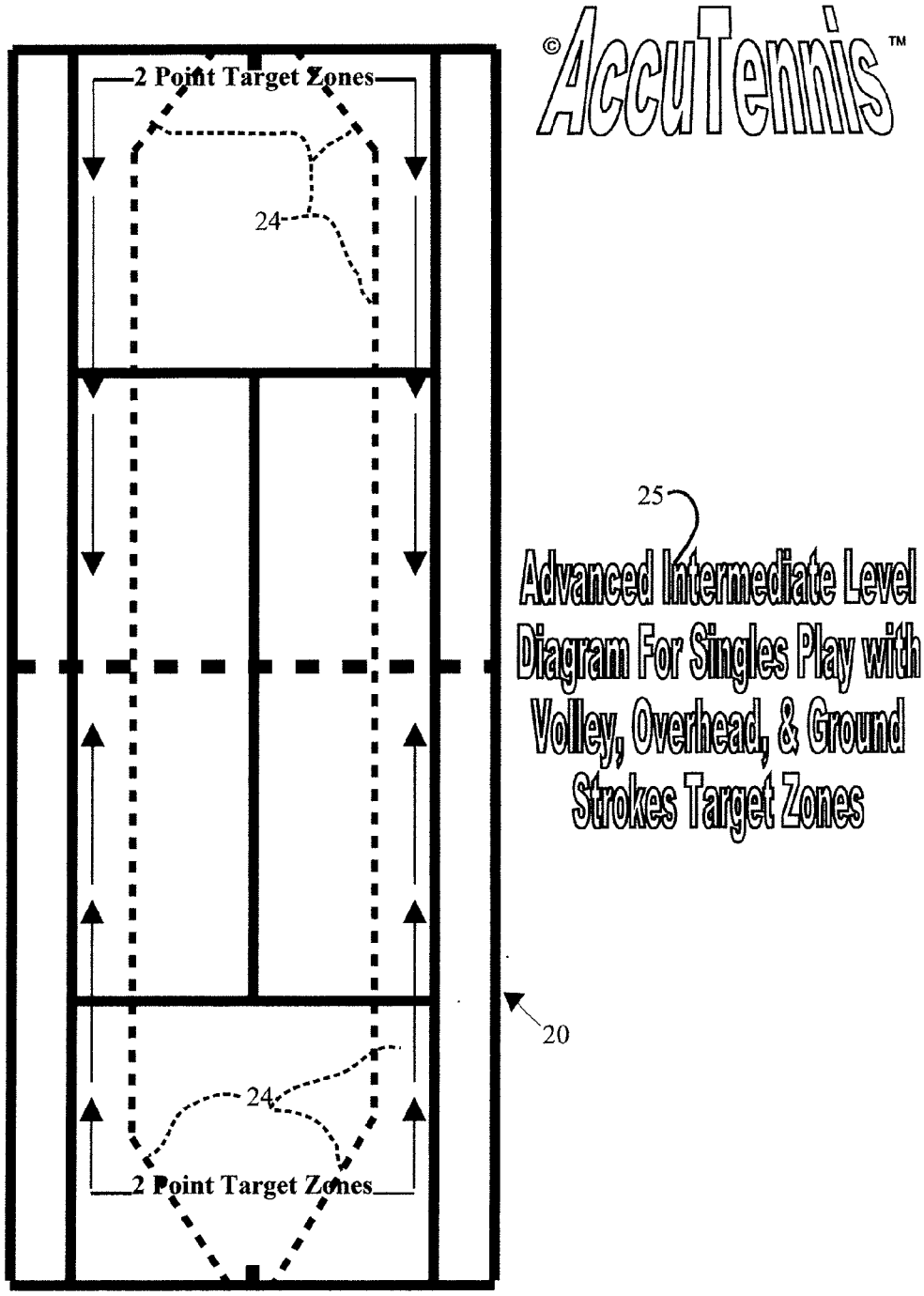
Figure 5.5
*Patent pending. AccuTennis™ is a trademark of tennis professional Kip Leftwich, USPTA.

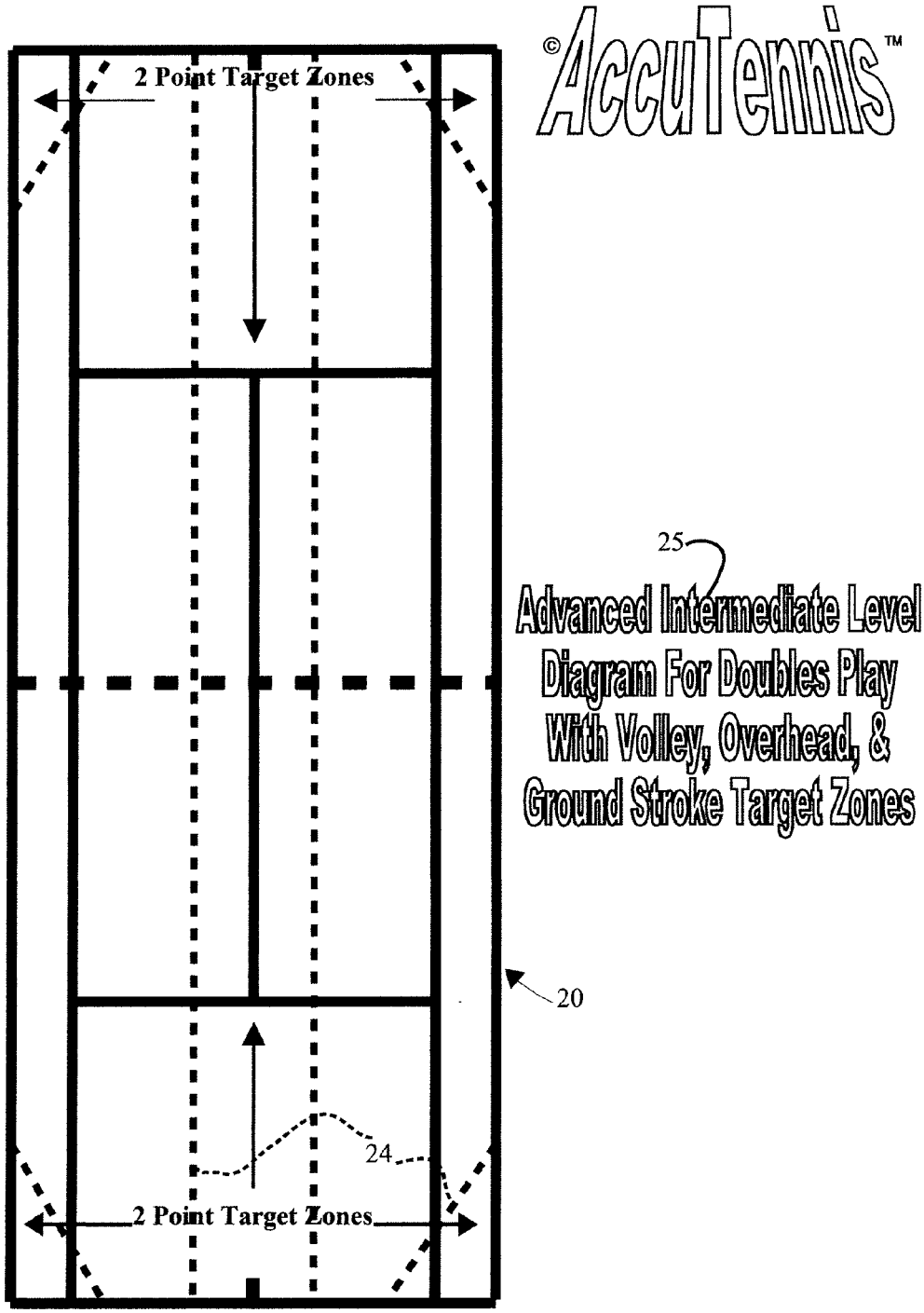
Figure 5.6
*Patent pending. AccuTennis™ is a trademark of tennis professional Kip Leftwich, USPTA.

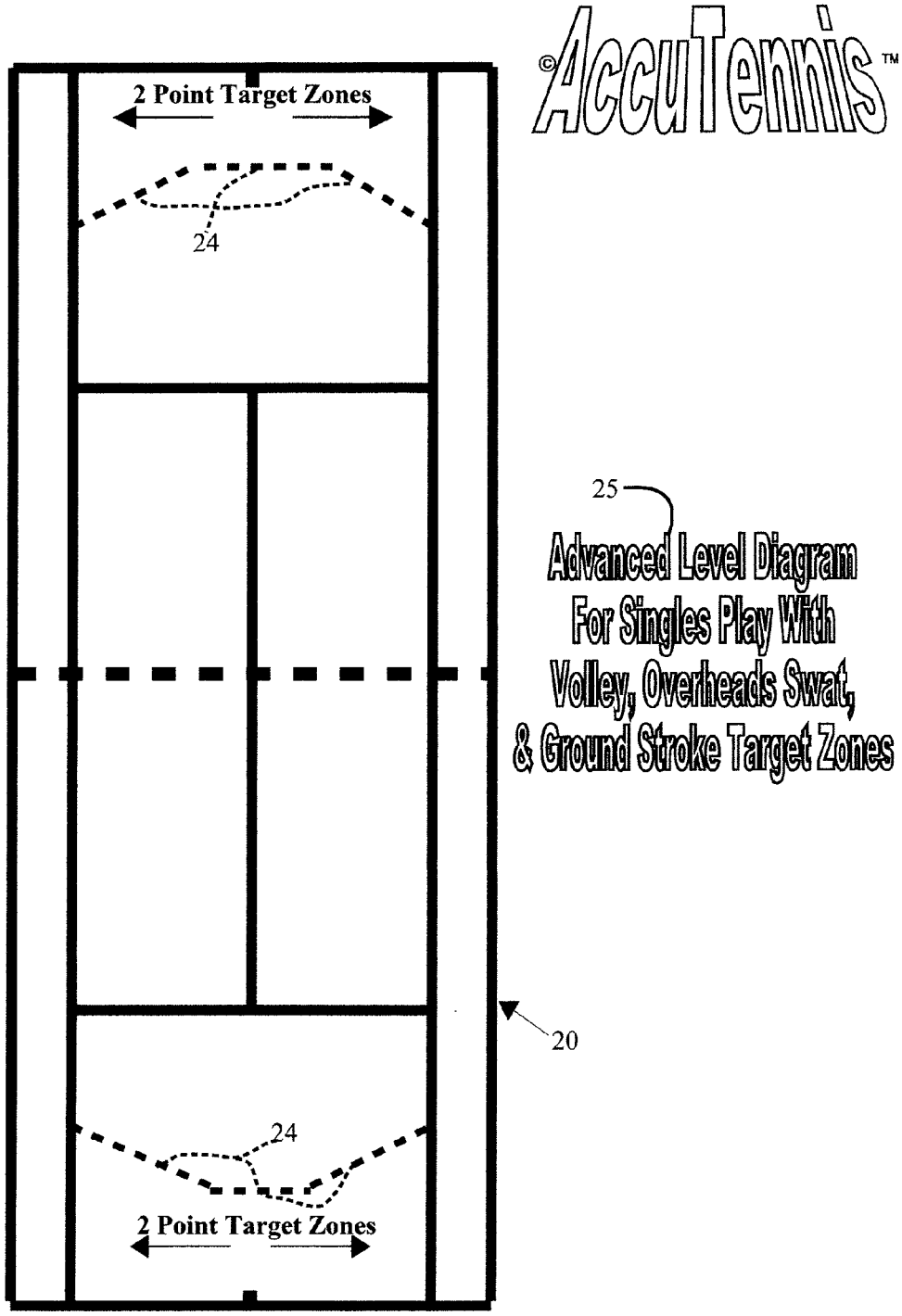
Figure 5.7
*Patent pending. AccuTennis™ is a trademark of tennis professional Kip Leftwich, USPTA.

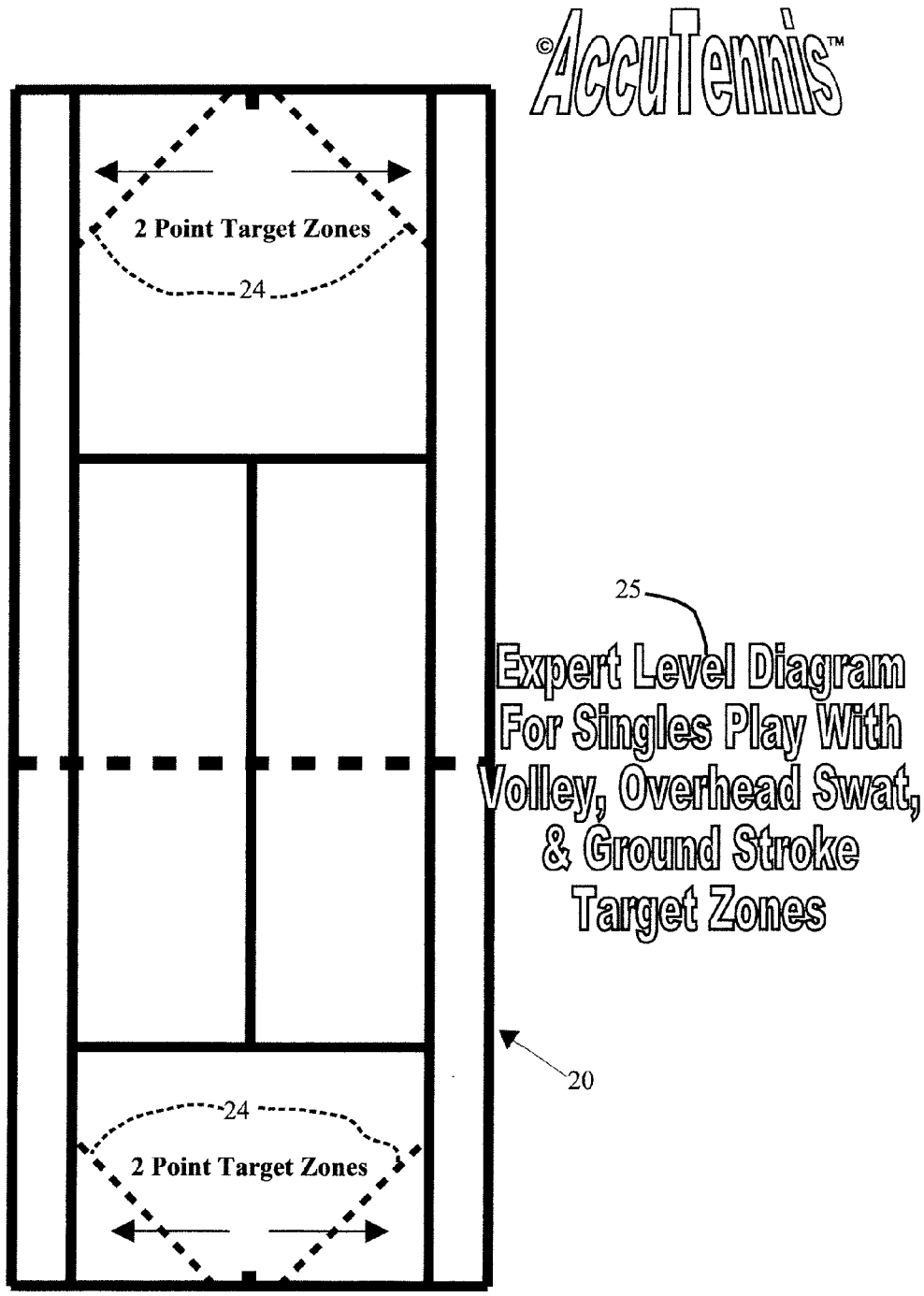
Figure 5.8
*Patent pending. AccuTennis™ is a trademark of tennis professional Kip Leftwich, USPTA.

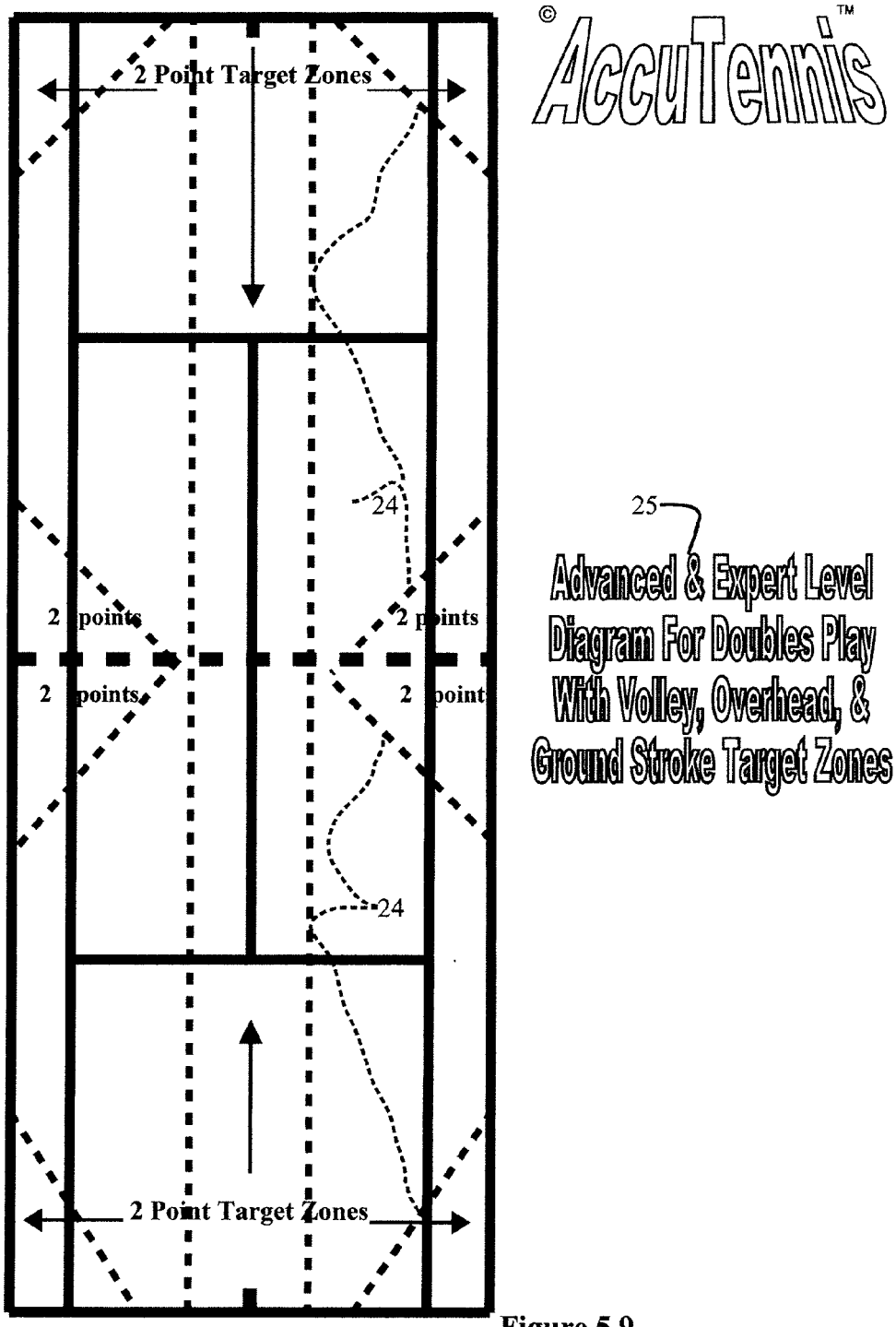
Figure 5.9
*Patent pending. AccuTennis™ is a trademark of tennis professional Kip Leftwich, USPTA.

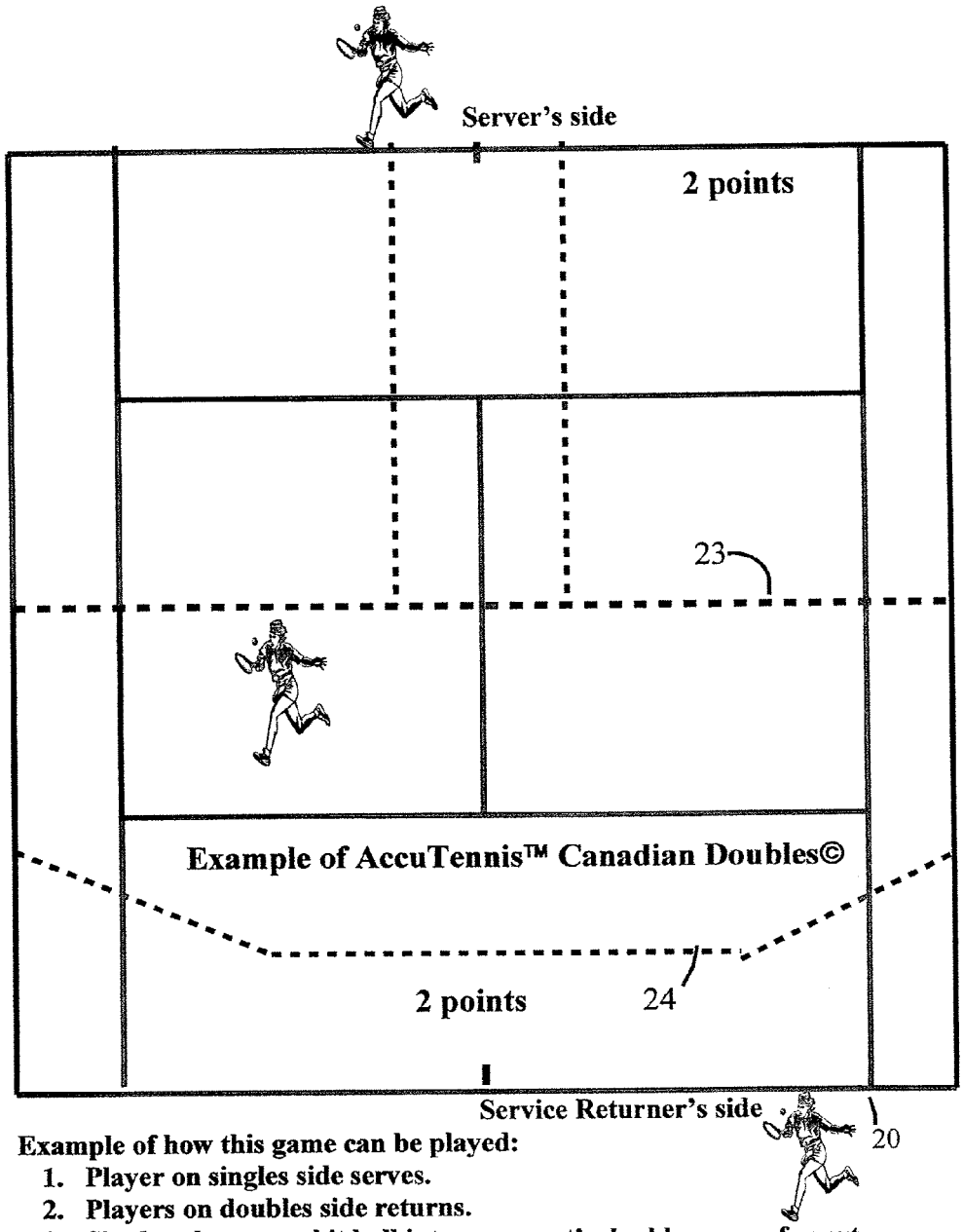

Example of how this game can be played:

1. Player on singles side serves.
2. Players on doubles side returns.
3. Singles player can hit ball into opponent's doubles area of court.
4. Doubles player's hit into opponent's singles area of court.
5. Players rotate clockwise after singles player completes 4 service points.
6. The first player that wins 15 points wins set, and the player who wins the first two sets wins match, or first player to win 21 points wins match.

Figure 7

RACQUET AND BALL SPORT COURT AND TARGET SYSTEM

CROSS-REFERENCE TO RELATED APPLICATIONS

U.S. Provisional Patent Application No. 60/611,206, filed 17 Sep. 2004 for "Tennis Target System", is incorporated herein by reference. U.S. Provisional Patent Application No. 60/601,554, filed 13 Aug. 2004 for "Tennis Target System", is incorporated herein by reference. Priority of both of these patent applications is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to racquet and ball games such as tennis and more particularly to a high precision targeting system that helps athletes and other game participants such as tennis players improve. Even more particularly, the present invention relates to a high precision targeting system in the form of a game that helps tennis players improve their skills and wherein the game includes a container that provides various components to the player including game instructions, suggested layouts or maps for different selectable games, and a temporary marking material that enables a player to add temporary markings to a tennis court or other game court (that could also provide permanent boundary markings), the markings providing score areas that provide points to the player that hits the particular area with the tennis ball during the game.

2. General Background of the Invention

When it comes to teaching and learning tennis, current target systems don't allow live tennis action because they either provide court obstructions, and/or interfere with the integrity of the bounce of the ball. In addition, most target systems don't allow for quick, positive reinforcement and feedback of the skills the student is trying to learn. This can lead to student boredom, frustration, and a high "drop-out" rate.

The tournament process often discourages young people who continue with tennis lessons and play in tournaments. Such tournaments have lengthy downtime between matches. In addition to long days sitting and watching instead of playing tennis, the majority of these young players fall into a consolation bracket, a form of negative feedback.

Many systems have been patented that relate generally to practicing the game of tennis. The following such U.S. patents are incorporated herein by reference:

U.S. Pat. Nos.: 3,504,912; 4,045,422 No-line tennis court, 4,592,547 tennis practice and game apparatus; 4,948,372; 5,709,620; 5,816,953; 6,077,176; 6,135,456; 6,648,780 Tennis training device; 2004/0157686.

U.S. Patent Application Publication No. 2004/1057686 discloses an evaluation system for tennis skills using target zones with a point system for grading the tennis skills of a tennis player.

U.S. Pat. No. 5,709,620 discloses a tennis court training target assembly with two-dimensional targets strategically placed to teach tennis skills.

U.S. Pat. No. 5,816,953 discloses an interactive system for training in tennis where various colors are placed on sections of the court to provide selected targets and evaluations.

U.S. Pat. No. 6,077,176 discloses a tennis court trainer where removable targets are placed on the court.

BRIEF SUMMARY OF THE INVENTION

The apparatus of the present invention is a system for training players to play ball and racquet sports (e.g. tennis) better and to make more accurate shots and a higher percentage of winning shots. These shots are known to be the better shots to hit to win more games.

The present invention provides an improved method of playing a tennis match that includes providing a court having a court surface, a net, a plurality of temporary or permanently marked boundaries, the net dividing the court surface into opposing ends that are occupied by opponents during a match and a package that includes a number of components that are used in conjunction with the court surface.

The package includes a document that displays one or more court markings that correspond to selectable tennis game options. One or more rolls of material are within the container, each roll enabling a user to apply temporary markings to the court that correspond to one of the marking options of the document. An applicator enables a user to apply the material to the court surface. The method includes selecting one of the game options from the document, using the temporary marking material to mark the court surface with temporary markings that define target areas, and then playing the game. Optionally, both permanent court markings (e.g. traditional tennis court markings and temporary markings can be used. The target areas each define a point value that can be utilized to accumulate points or determine the final point value earned upon the last successful shot in each game rally of the ball. In the preferred method, the different target areas have different point values.

One of the court marking options includes different marking options for opposing sides of the court. This is where the method and apparatus of the present invention creates a handicap.

The preferred method can include marking the court surface with marking material that includes lines that form an acute angle with the net.

The preferred method can include marking the court surface with marking material that includes lines that form a right angle with the net.

In the preferred method, each of the areas are areas bounded by both permanent markings and temporary markings.

Some of the temporary markings can be parallel to the net. Some of the temporary markings can be generally perpendicular to the net.

In the preferred method, some of the areas can include triangular shaped areas that are bounded by both temporary and permanent markings.

In the preferred method, the areas can include rectangular areas that are bounded by both permanent and temporary markings.

In the preferred method, some of the temporary markings can include lines that are not linear including two line segments that form an obtuse angle, right angle, or acute angle.

The temporary markings can surround at least one area that includes lines that are a combination of at least one line parallel to the net and at least one line perpendicular to the net.

The method and apparatus of the present invention is designed to retain and increase the number of people playing tennis by providing players of all skill levels with an immediate, positive reinforcement to skill practice and game or tournament play. It can be used by teaching pros and by individuals when teaching pros are not available. It can be used as a transition tool for players who aspire to play tournaments but are discouraged or intimated by the traditional tournament process.

In the preferred method, the court is divided into target zones with removable court tape that allows for live play on hard courts. Court chalk is preferably used to create zones on grass or clay courts (rubico). Court chalk allows for live play without obstruction or interference with ball bounce. The court zone design is chosen according to the skill level or choice of the tennis player or teaching pro. Each zone carries with it a certain point value (see illustration of court zone designs). Points are accumulated or earned by hitting the ball into the zones.

The target system of the present invention provides an excellent tennis teaching tool. It motivates players by allowing them to hit a higher percentage of winning shots into zoned areas of the court as compared to traditional target systems. It creates muscle memory which helps players win more games. It adds fun to lessons by allowing live ball play and practice without obstructing the court or changing the bounce of the ball. It gives quick and positive feedback to players when competing against others or themselves. It allows players to set personal point goals and records during practice or play. Players can coach themselves when a teaching professional is not available. It improves match play by focusing on hitting into winning shot zones. It sharpens ground strokes, volleys, overheads and serves. It provides a challenging workout to sharpens physical and mental tennis skills. It prepares aspiring tournament players to transition into Grand Prix, regional, national, and NTRP League matches and tournaments. It allows more players to compete in more matches in less time which helps to increase revenue and decrease tournament costs. It reduces players' "sit around" time between matches and keeps them involved and reduces boredom. It more readily allows for a round robin environment which increases players' interaction with players of different levels and styles. The present invention has a built in handicap keeps the matches competitive and exciting.

In summary, the present invention includes playing a game, set, and match of tennis and attempting to win each by scoring a predetermined number of points or by accumulating points as the ball hits the designated target zones. In an accumulation method of scoring it could be possible for the participant with most points to be the winner of each game, set, and match. The points could be counted by other observers and/or by cameras specifically focused on each zone. In this method, a "scoreboard" like that used in basketball could be used. Points are usually earned after hitting a winning shot or an unforced error and are normally only earned at the end of each rally (except in ball machine play, beginner level play, cross court drills, and down the line drills, as in all of these there is no opponent). The quantity of points earned depends on the previously agreed upon AccuTennis court design and where the ball lands on the last successful stroke. Players rotate serves and sides after a certain number of serves and points are accumulated. Games, sets and matches are won when the first player reaches the respective target quantity.

BRIEF DESCRIPTION OF THE DRAWINGS

FIG. 7 is a schematic diagram illustrating an example of one of the games that can be played using the apparatus of the present invention that is entitled Canadian Doubles.

DETAILED DESCRIPTION OF THE INVENTION

Figure 1:
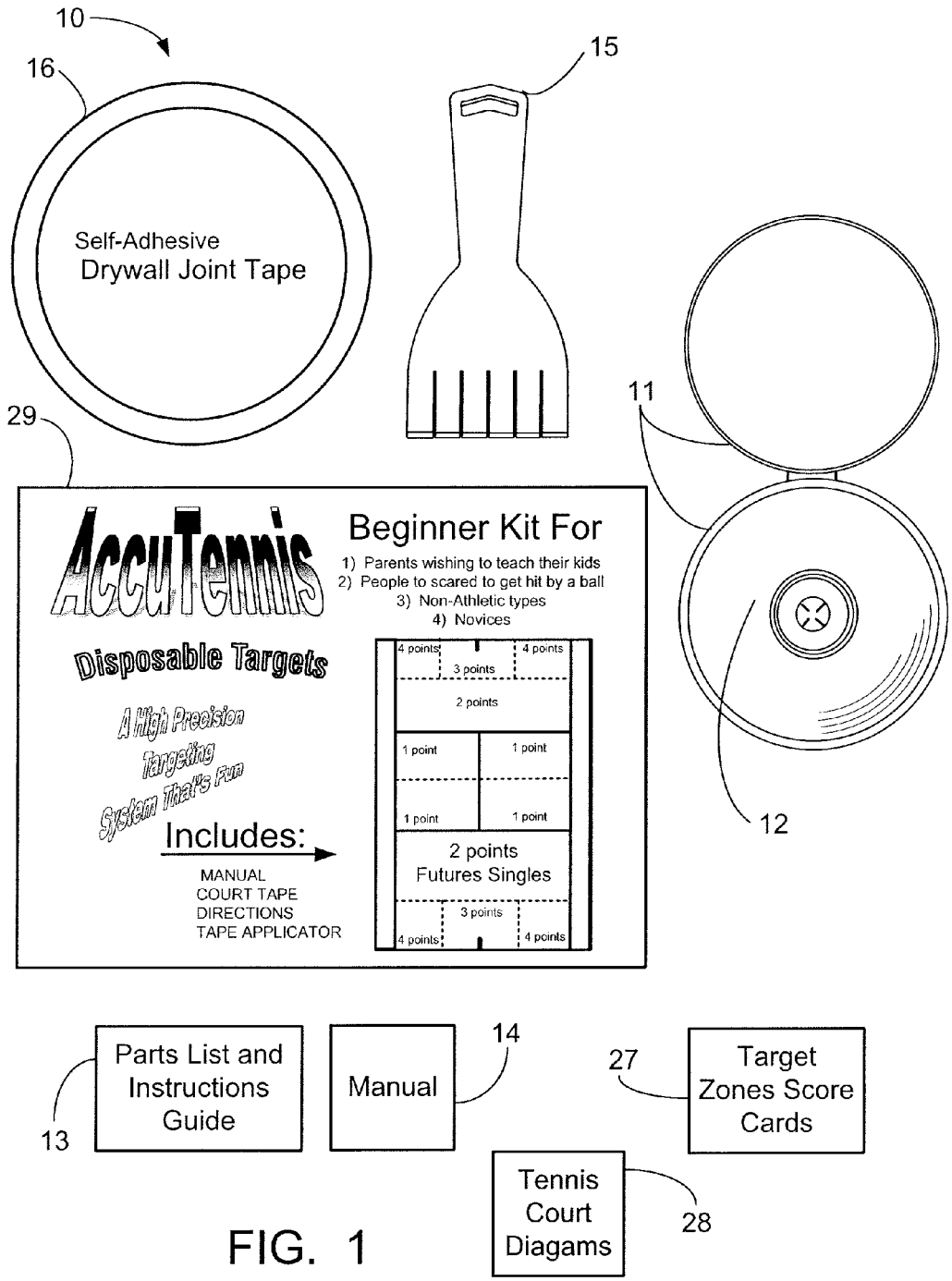
FIG. 1 is a perspective view of the preferred embodiment of the apparatus of the present invention.
Figure 2:
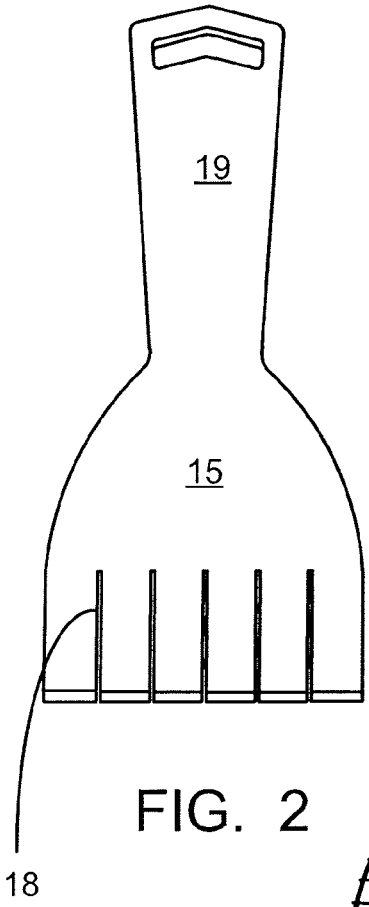
FIG. 2 is a fragmentary view of the preferred embodiment of the apparatus of the present invention illustrating the applicator.

FIGS. 1-4 show the preferred embodiment of the apparatus of the present invention, designated by the numeral 10 in FIG. 1.

Figure 3:
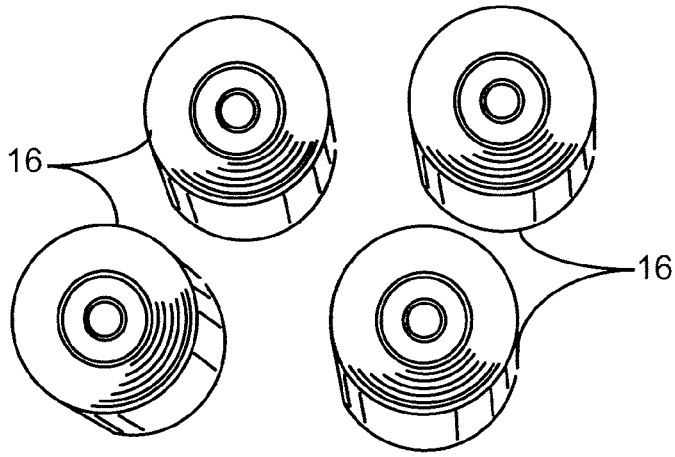
FIG. 3 is a partial perspective view of the preferred embodiment of the apparatus of the present invention illustrating multiple rolls of adhesive tape that can be used to apply the temporary markings.
Figure 4:
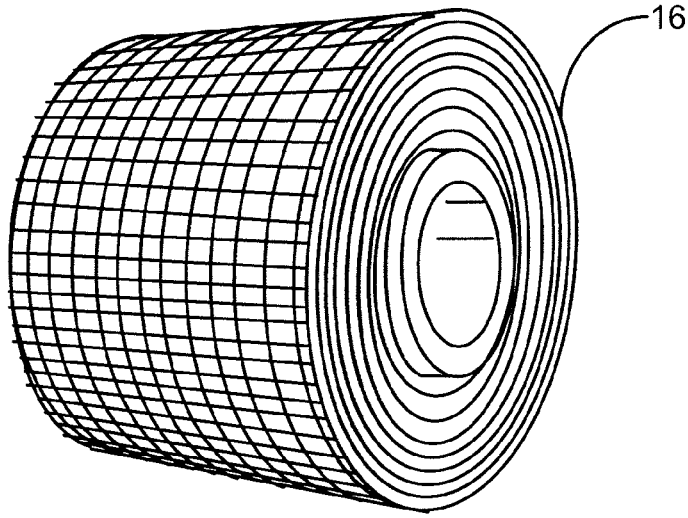
FIG. 4 is a fragmentary perspective view of one of the rolls of FIG. 3.
Figure 5:
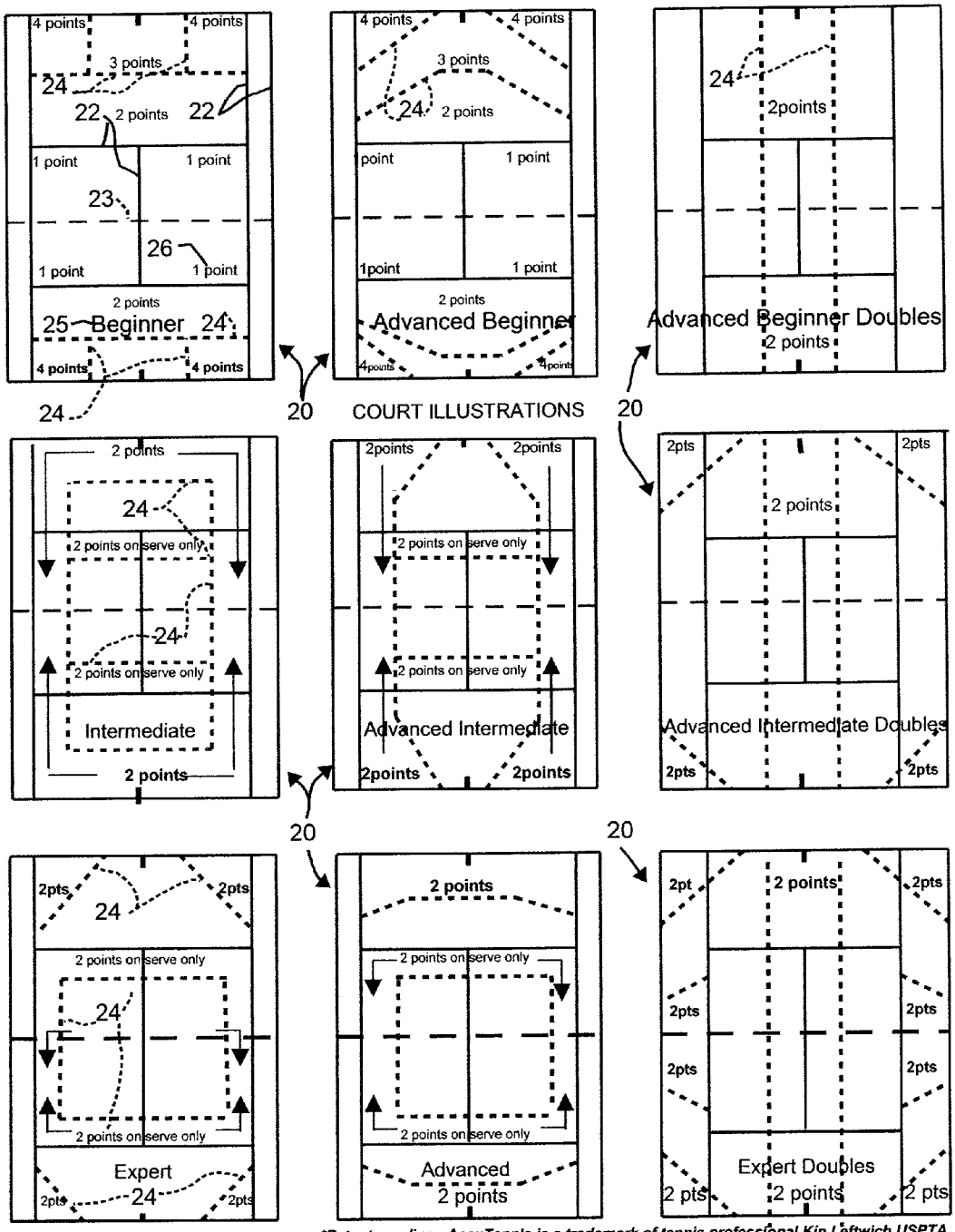
FIGS. 5-5.9 are schematic diagrams illustrating the various court plan options and corresponding games that can be prepared using the apparatus 10 of the present invention and following the enclosed instructions.
Figure 6:
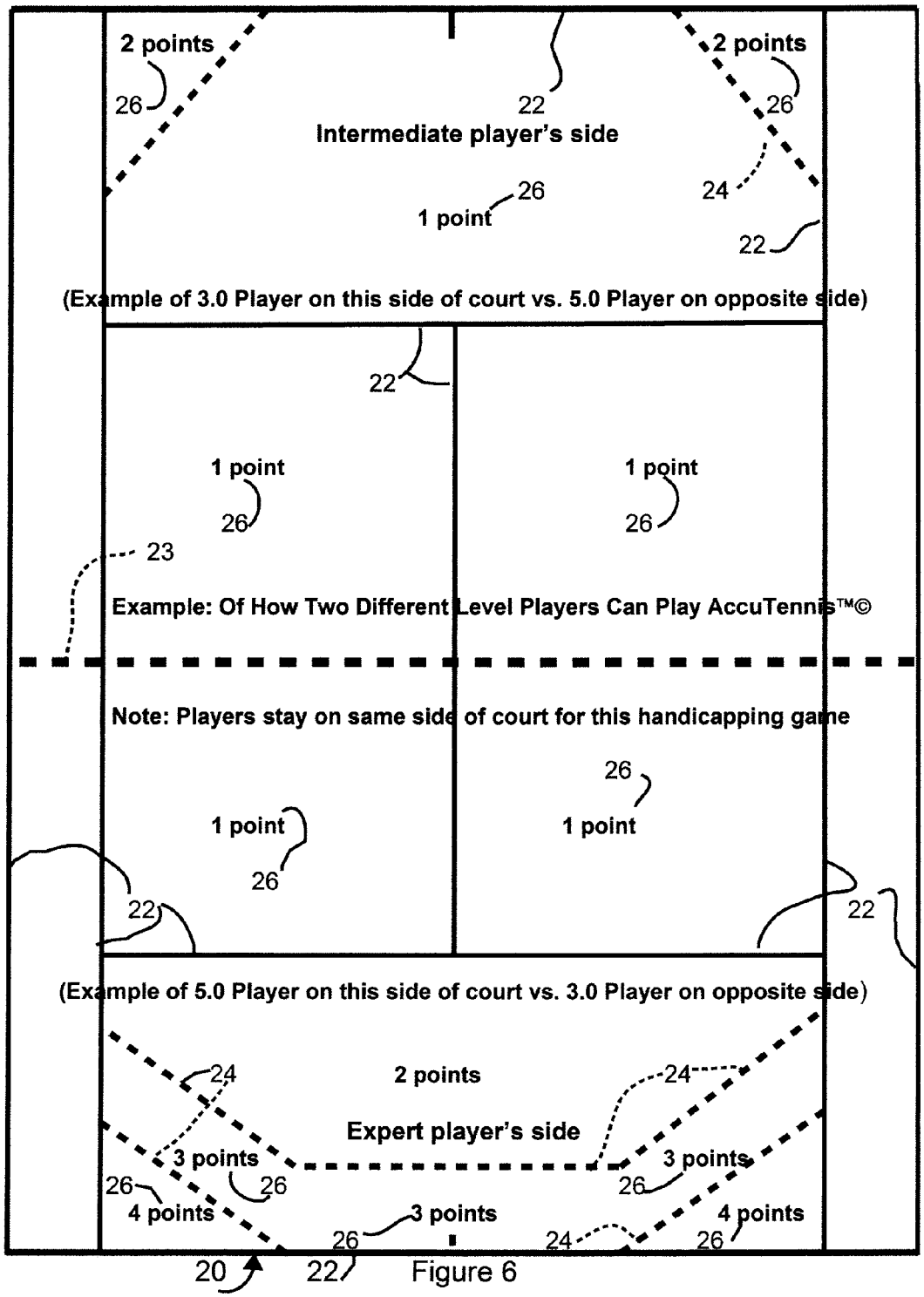
FIG. 6 is an enlarged view of a single court plan option.

Inside the packaging is provided one or more tape rolls 16. As shown in FIGS. 3 and 4, each tape roll 16 provides a tape web 17 that is preferably of a material that will adhere to court surface 21 of a selected tennis court. The tape web 17 is preferably a fiber tape that will adhere to a hard court surface and that will not interfere with the integrity of the bounce of the ball nor disintegrate during play. The tape can be drywall fiber tape (such as 1 ⅞" wide self-adhesive fiberglass mesh drywall joint and patch tape, commercially available from Saint-Gobain Tech Fabrics (sold as FibaTapem in lengths of 50 feet through 500 feet)). The court surface can be of any known tennis court material that provides a hard court surface. In order to apply the tape web 17 to the court surface 21, applicator 15 is gripped at handle 19 so that blade 18 engages the tape web 17 pressing it against court surface 21 and adhering it thereto. In accordance with the method of the present invention, the packaging also includes documents that display multiple court marking options that correspond to selectable tennis game options. The documents included in the packaging can also provide game rules or game instructions (for example, see FIG. 7 and exhibits A and E). In FIGS. 5, 6 and 7, various court plan options 20 are shown. In FIG. 5, for example, nine different court plan options 20 are shown. In FIGS. 5, 6 and 7, the solid lines correspond to permanent markings 22 which are the traditional court lines for a tennis court. In addition, the dotted lines in FIGS. 5, 6 and 7 show the traditional position of the net as numeral 23 and the other temporary markings that correspond to the position of tape web 17 as numeral 24. In FIGS. 5 and 6, it can also be seen a game title 25 for each of the nine games shown in FIG. 5 and for the single game shown in FIG. 6. In addition, various area point designations 26 are shown. These point designations give a point value for a specified area when the player strikes the tennis ball with his or her racquet and drives the ball to that particular area. For example, in the enlarged court plan option 20 of FIG. 6, four generally rectangular areas are shown nearest net 23, each having an area point designation as one point. In FIG. 6, an intermediate players' side is shown having a trapezoidal area with point designation 26 as one point. However, next to the intermediate players' side of FIG. 6, there is shown two triangular areas having area point designation 26 of two points each. In FIG. 6, notice that the areas having point designations 26 differ on opposing sides of net 23. The intermediate players' side would typically be occupied by a player of lesser skill. That player has possible point areas with point designations 26 of three points and four points. The expert players' side only has possible point designations 26 of one and two points. Therefore, FIG. 6 illustrates a court plan option 20 that handicaps the expert player and helps the intermediate player.

More information about the present invention can be found in the attached pages, all incorporated herein by reference.

EXAMPLES

AccuTennis™ Tennis Court Parts List©

1 Roll of tape (50-500 feet long)

1 Tape applicator.

1 Parts and instruction list.

2 AccuTennis scoring systems.

1 Illustration of court designs.

AccuTennis™ Parts List

Beginner Level (Singles):

1 Instruction Guide.

1 Manual.

1 Tennis Court Diagram.

6 Target Zones Points Card.

1 Roll of Tape (50-150 feet long).

1 Tape Applicator.

AccuTennis™ Instructions Guide For The Beginner

Note: For use on a hard court surface!

Part 1

1. Remove debris and dust where fiber tape is to be applied.

2. Use the AccuTennis Tennis Court Diagram as a guide for applying tape.

3. Apply the fiber tape with its sticky side facing the surface.

4. Use side A of the applicator to wipe tape.

5. Cut tape with scissors.

Part 2

1. Refer to the "CD or Manual" and begin play.

2. Use the AccuTennis Target Zones Game Set, and Math Score Cards to record score.

patent pending. AccuTennis is a Trademark of tennis professional Kip Leftwich USPTA. For technical support call 985.246.9115.

AccuTennis Manual for: Beginner Level (Singles)

Part 1

A. Grip

Description: Holding the tennis racket.

1. For the Forehand and Backhand Volley, Ground Stroke, and the Overhead-Swat.

a) Right and left handed beginner.

Step 1) Just let him (her) grip the racquet that feels most natural.

B. Feeds by a Parent or Partner

Description: The toss or drop of a tennis ball to the beginner by a partner.

1. Volley Feeds a) For forehand and backhand sides.

Step 1) Stand on the other side of the net, and 4 to 6 feet in front of the beginner!

Step 2) Toss the ball underhand aiming at the racquet strings.

2. Overhead-Swat Feeds a) For right and left handed beginners.

Step 1) Stand on the other side of the net, and 6 to 8 feet in front of the beginner!

Step 2) Toss the ball underhand aiming 4 to 6 feet above the shoulder.

1. For the right-handed beginner—toss the ball over their right shoulder.
2. For the left-handed beginner—toss the ball over their left shoulder.

3. Ground Stroke Feeds a) For right and left handed beginners.

Step 1) Stand 4 to 6 feet on to the side of beginner where their racquet is located.

Step 2) Then stand 1 to 2 feet in front of the beginner!

Step 3) Hold the tennis ball with fingertips.

Step 4) Face the ball toward the ground.

Step 5) Lift the ball 3 to 5 feet in the air.

Step 6) Let the ball drop to the ground without force.

Step 7) The beginner will swing at the ball after it bounces, and reaches their waist area.

Part 2

A. The Volley

Description: The push of the tennis racquet toward the ball.

1. The Standing Position and the Volley.

a) The right-handed forehand volley:

Step 1) Hold the tennis racquet in the right hand.

Step 2) Turn with the left shoulder, and racquet strings facing the net.

Step 3) Tilt the tennis racquet slightly back.

Step 4) Place the racquet handle one-foot in front of the chest.

Step 5) Aim the racquet strings at the ball, and push up & away from the body.

Step 6) Freeze the tennis racquet just after contact with the ball.

Step 7) Each time the tennis ball lands in an AccuTennis point zone the beginner will say out loud their game score.

Step 8) When feeds are done the beginner will write their score on the AccuTennis Target Zones Points Card.

b) The left-handed forehand volley:

Step 1) Hold the tennis racquet in the left hand.

Step 2) Turn with the right shoulder, and racquet strings facing the net.

Steps 3 thru 7) Same as the right-handed steps 3 thru 8.

c) The right-handed backhand volley:

Step 1) Hold the tennis racquet in the left hand. If two hands are needed, place the left hand above the right.

Step 2) Turn with the right shoulder, and racquet strings facing the net.

Steps 3 thru 8) Same as the right-handed steps 3 thru 8.

d) The left-handed backhand volley:

Step 1) Hold the tennis racquet in the left hand. If two hands are needed, place the right hand above the left.

Step 2) Turn with the left shoulder, and racquet strings facing the net.

Steps 3 thru 8) Same as the right-handed steps 3 thru 8.

A. The Overhead Swat

Description: The swat of the tennis racquet at the ball when it's over the head.

1. The Standing Position and the Overhead Swat.

a) The right-handed overhead swat:

Step 1) Hold the tennis racquet in the right hand.

Step 2) Turn with the left shoulder facing the net.

Step 3) Position the right arm as if throwing something. The tennis racquet should be scratching the back.

Step 4) Raise the left hand and be ready to point it at the tennis ball.

Step 5) When the ball is over the right shoulder, swat the tennis racquet at the ball, and let the racquet swing down across the left leg.

Step 6) Let the left hand fall by itself during the swat.

Steps 7 and 8) Same as the right-handed forehand volley 7 & 8.

b) The left-handed overhead swat:

Step 1) Hold the tennis racquet in the left hand.

Step 2) Turn with the right shoulder facing the net.

Step 3) Position the left arm as if throwing something. The tennis racquet should be scratching the back.

Step 4) Raise the right hand and be ready to point it at the tennis ball.

Step 5) When the ball is over the left shoulder, swat the tennis racquet at the ball, and let the racquet swing down across the right leg.

Step 6) Let the right hand fall by itself during the swat.

Steps 7 and 8) Same as the right-handed forehand volley 7 & 8.

C. The Ground Stroke

Description: The swing of the tennis racquet at the ball when the ball is in front of the body.

1. The Right-Handed Forehand Ground Stroke:

Step 1) Stand with both feet shoulders length apart facing the net.

Step 2) Hold the grip of the tennis racquet in the right hand.

Step 3) Bring the racquet back behind the right hip.

Step 4) Swing forward after the tennis ball bounces, and reaches waist level.

Step 5) Aim the strings of the racquet at the ball.

Step 6) Finish by allowing the arm to stop on it's own.

Steps 7 and 8) Same as the right-handed forehand volley 7 & 8.

2. The Left-Handed Forehand Ground Stroke:

Step 1) Stand with both feet shoulders length apart facing the net.

Step 2) Hold the grip of the tennis racquet in the right.

Step 3) Bring the racquet back behind the left hip.

Steps 4 thru 8) Same as the right-handed forehand steps 4 thru 8.

3. The Right-Handed Backhand Ground Stroke:

Step 1) Stand with both feet shoulders length apart facing the net.

Step 2) Hold the bottom of the tennis racquet with the right hand.

Step 3) Place the left hand above the right hand, and grip.

Step 4) Bring the racquet back behind the left hip.

Step 5) Swing forward after the tennis ball bounces, and reaches waist level.

Step 6) Aim the strings of the racquet at the ball.

Step 7) Finish by allowing the arms to stop on it's own.

Steps 8 and 9) Same as the right-handed forehand volley 7 & 8.

4. The Left-Handed Backhand:

Step 1) Stand with both feet shoulders length apart facing the net.

Step 2) Hold the bottom of the tennis racquet with the left hand.

Step 3) Place the right hand above the left hand, and grip.

Step 4) Bring the racquet back behind the right hip.

Steps 5 thru 9) Same as the right-handed backhand steps 5 thru 9.

patent pending. AccuTennis is a trademark of tennis professional Kip Leftwich, USPTA.

The following is a list of variations incorporated in this patent by reference hereto: AccuTennis Advanced Beginner Singles, AccuTennis Advanced Beginner Doubles, AccuTennis Intermediate Singles, AccuTennis Advanced Intermediate Singles, AccuTennis Advanced Intermediate Doubles, AccuTennis Advanced Singles, AccuTennis Advanced Expert Doubles, AccuTennis Expert Singles, AccuTennis Ball Machine, AccuTennis Canadian Doubles, AccuTennis Physically Impaired vs. Non-Physically Impaired, AccuTennis Handicapping System, and AccuTennis Live Ball Cross Court and Down-the-Line Drills. See Attachments annexed hereto respectively as exhibits "A" through "N".

PARTS LIST

The following is a list of suitable parts and materials for the various elements of the preferred embodiment of the present invention.

| Part Number | Description |
|---|---|
| 10 | tennis targeting system |
| 11 | container for CD 12 |
| 12 | compact disc (CD) |
| 13 | parts list and instruction guide |
| 14 | manual |
| 15 | applicator |
| 16 | tape roll |
| 17 | tape web |
| 18 | blade |
| 19 | handle |
| 20 | court plan options |
| 21 | court surface |
| 22 | permanent marking |
| 23 | net |

-continued

| Part Number | Description |
|---|---|
| 24 | temporary marking |
| 25 | game title |
| 26 | area point designation |
| 27 | tennis court diagram |
| 28 | target zones score card |
| 29 | label on packaging |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of playing a tennis match comprising the steps of:

a) providing a tennis court having a court surface, a net, and marked boundaries, the net dividing the court surface into opposing ends;

b) providing a package containing:

a document that displays court markings that correspond to selectable tennis game options, one or more rolls of material for applying temporary markings to the court that correspond to one of the marking options, and an applicator that enables a user to apply the material to the court surface;

c) selecting one of the game options;

d) using the temporary marking material to mark the court surface with temporary markings that define target areas;

e) playing the game wherein the target areas each define a point value that can be added to a player's score when the player strikes the target area with a ball; and f) wherein in step "e" different target areas have different point values.

2. The method of claim 1 wherein one of the court marking options includes different marking options for opposing sides of the court.

3. The method of claim 1 wherein step "d" includes marking the court surface with marking material that includes lines that form and acute angle with the net.

4. The method of claim 1 wherein step "d" includes marking the court surface with marking material that includes lines that form a right angle with the net.

5. The method of claim 1 wherein each of the areas are areas bounded by permanent markings and temporary markings.

6. The method of claim 1 wherein some of the temporary markings are parallel to the net.

7. The method of claim 1 wherein some of the temporary markings are perpendicular to the net.

8. The method of claim 1 wherein the areas include triangular areas that are bounded by both permanent and temporary markings.

9. The method of claim 1 wherein the areas include rectangular areas that are bounded by both permanent and temporary markings.

10. The method of claim 1 wherein the temporary markings include lines that are not linear.

11. The method of claim 1 wherein the temporary markings surrounding at least one area include lines that are a combination of at least one line parallel to the net and at least one line perpendicular to the net.

12. The method of claim 1 wherein the temporary markings surrounding at least one area include lines that are a combination of at least one line parallel to the net and at least one line that forms an acute angle with the net.

13. The method of claim 1 wherein the target areas farther from the net have higher point values.

14. A method of playing a tennis match on a tennis court having a court surface, a net, and marked boundaries, the net dividing the court surface into opposing ends that are occupied by opponents during a match, comprising the steps of:

a) providing a package containing:

a document that displays court markings that correspond to selectable tennis game options, one or more rolls of material for applying temporary markings to the court that correspond to one of the marking options, and an applicator that enables a user to apply the material to the court surface;

b) selecting one of the game options;

c) using the temporary marking material to mark the court surface with temporary markings that define target areas;

d) playing the game wherein the target areas each define a point value that can be added to a player's score when the player strikes the target area with a ball; and e) wherein in step "d" different target areas have different point values.

15. A method of playing a racquet and ball match comprising the steps of:

a) providing a court having a court surface and a net that divides the court surface into opposing ends;

b) providing a package containing:

a document that displays multiple court marking options that correspond to selectable game options, one or more rolls of material for applying temporary markings to the court that correspond to one of the marking options, and an applicator that enables a user to apply the material to the court surface;

c) selecting one of the game options;

d) using the temporary marking material to mark the court surface with temporary markings that define target areas;

e) playing the game wherein the target areas each define a point value that can be added to a player's score when the player strikes the target area with a ball; and f) wherein in step "e" different target areas have different point values.

16. The method of claim 15 wherein one of the court marking options includes different marking options for opposing sides of the court.

17. The method of claim 15 wherein step "d" includes marking the court surface with marking material that includes lines that form and acute angle with the net.

18. The method of claim 15 wherein step "d" includes marking the court surface with marking material that includes lines that form a right angle with the net.

19. The method of claim 15 wherein the court has permanent markings before applying temporary markings in step "d", wherein each of the target areas are areas bounded by permanent markings and temporary markings.

20. The method of claim 15 wherein some of the temporary markings are parallel to the net.

21. The method of claim 15 wherein some of the temporary markings are perpendicular to the net.

22. The method of claim 15 wherein the areas include triangular areas.

23. The method of claim 15 wherein the areas include rectangular areas.

24. The method of claim 15 wherein the temporary markings include lines that are not linear.

25. The method of claim 15 wherein the temporary markings surrounding at least one area include lines that are a combination of at least one line parallel to the net and at least one line perpendicular to the net.

26. The method of claim 15 wherein the temporary markings surrounding at least one area include lines that are a combination of at least one line parallel to the net and at least one line that forms an acute angle with the net.

27. The method of claim 15 wherein the target areas farther from the net have higher point values.

* * * * *